United States Patent [19]

Ichimura

[11] Patent Number: 4,800,829

[45] Date of Patent: Jan. 31, 1989

[54] DEVICE FOR PLACING A PRESSER FOOT IN AN AUTOMATIC SEWING MACHINE

[75] Inventor: Masatoshi Ichimura, Higashiosaka, Japan

[73] Assignee: Satoh Seiki Co., Ltd., Japan

[21] Appl. No.: 834,541

[22] Filed: Feb. 28, 1986

[51] Int. Cl.[4] ..... D05B 29/00

[52] U.S. Cl. ..... 112/240; 29/33 K

[58] Field of Search ..... 901/37; 29/33 K; 112/239, 240; 294/116

[56] References Cited

U.S. PATENT DOCUMENTS

| | | | |
|---|---|---|---|
| 2,822,094 | 2/1958 | Greer | 901/37 X |
| 4,212,256 | 7/1980 | Jimenez | 112/240 |
| 4,278,039 | 7/1981 | Hanyu et al. | 112/240 |
| 4,492,173 | 1/1985 | Hirose | 112/240 |
| 4,577,570 | 3/1986 | Ichimura | 112/121.12 |
| 4,597,714 | 7/1986 | Morrison et al. | 901/37 X |

FOREIGN PATENT DOCUMENTS

| | | | |
|---|---|---|---|
| 0595145 | 4/1978 | U.S.S.R. | 901/37 |
| 0663577 | 5/1979 | U.S.S.R. | 901/37 |
| 0848353 | 4/1981 | U.S.S.R. | 901/37 |

*Primary Examiner*—Z. R. Bilinsky

*Attorney, Agent, or Firm*—Larson and Taylor

[57] ABSTRACT

A sewing machine having a presser foot for positioning a fabric to be sewn and a device for holding the presser foot. This device comprises a pair of hook arms, the ends of which releasably engage a presser foot and a scissor arm actuating device for actuating or releasing the hook arms. The actuating device and the hook arms form a unit which is movable together towards and away from the presser foot.

5 Claims, 2 Drawing Sheets

DEVICE FOR PLACING A PRESSER FOOT IN AN AUTOMATIC SEWING MACHINE

FIELD OF THE INVENTION

This invention relates to a device for placing a pressure foot applied on a tailoring fabric. Particularly, this invention relates to a device for placing a pressure foot applied on a patch cloth to be hem-sewn with an underlying base fabric.

DESCRIPTION OF THE RELATED ART

Recent automatic sewing business requires performance of sewing with high efficiency which includes rationalization of preparatory time and also switching time to the next job. Making reference to such a kind of problem as involved in an automatic pocket sewing machine where formation of a patch pocket is intended on a suit fabric by hem-sewing of a patch cloth, a pressure foot has been manually set on the patch cloth with little problem, because recent pressure foots are made of plastic and their light weight obviates the use of much time for accurate orientation with manual operators. However, quick, easy placement and displacement work of the pressure foot has been a problem to determine how efficiently the intended sewing job will be prepared or switched in a line flow system.

SUMMARY OF THE INVENTION

This invention is mainly intended to solve problems involved in placement of the pressure foot before start of the sewing and in displacement of the same after the sewing finishes. Specifically, this invention offers a vertically displaciable device comprising means for pressing and hooking a pressure foot on its top face, further means for release and unhook thereof other objects as well as advantages attained by this invention will be apparent through descriptions hereinafter.

BRIEFING OF THE DRAWING

Figure 1:
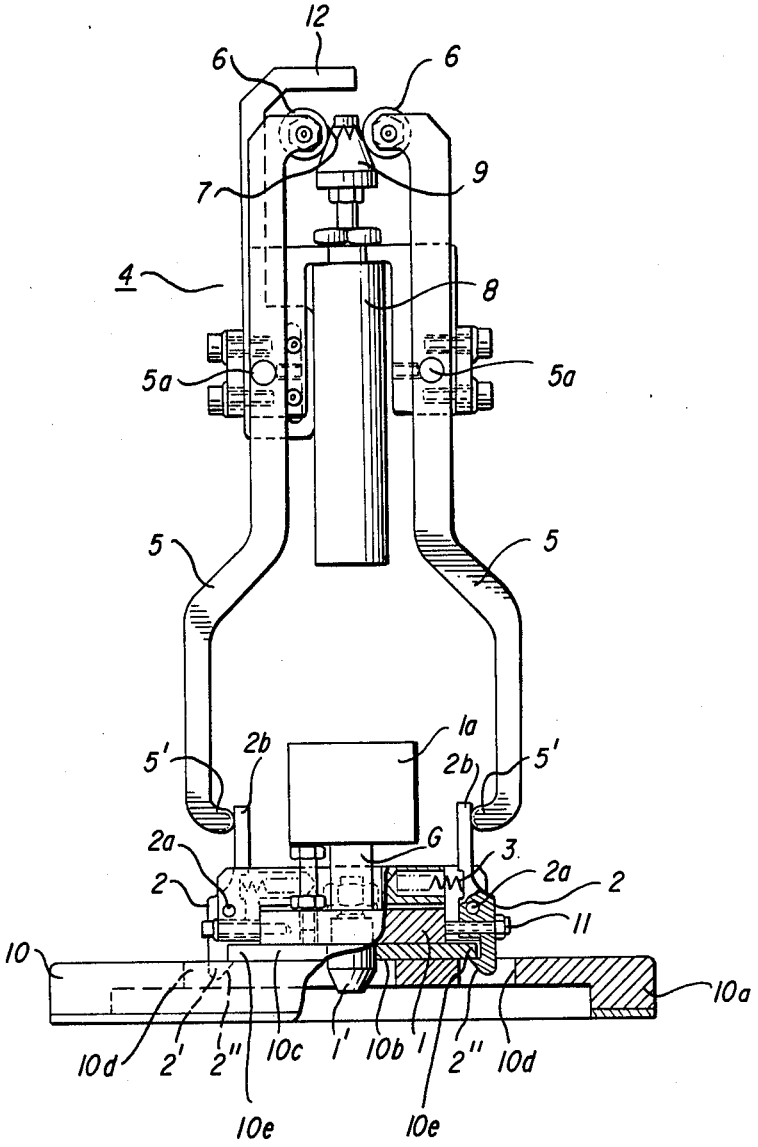
FIG. 1 shows a front drawing of an embodimentof this invention partly broken and partly abbreviated for simplicity sake while the embodied device is in engagement with a pressure foot.

These drawings are presented by way of illustrating this invention. Therefore these should not be construed as limiting the invention.

DESCRIPTION OF THE INVENTIVE EMBODIMENT

This invention will be detailed hereinbelow with reference to a preferred embodiment shown in drawings. The numeral 1 is a base plate equipped with hook means as well as other functional elements as will be noted below, and 1*a* is a beam, located above the base plate 1, where the plate 1 and the beam 1*a* are connected and adapted to displace or move up and down as one unit vertically along guide columns G, G(abbreviated in FIG. 1 and 2, but shown in FIG. 3) by some power source which is also abbreviated from drawings. 1' is a block projected from the bottom face of the plate 1, and 2, 2 are hook arms pivoted at the side centers 2*a*, 2*a* of the plate 1 and urged by a spring 3, 3 respectively. The bottom tip of each arm 2 is curved inwardly to make a hook nail as numbered 2', 2''. The numerals 11, 11 are screws to adjust the urging force by the springs 3, 3 respectively.

The numeral 10 is a pressure foot, normally molded of transparent acrylic resin, having a gross contour similar to a patch cloth, not shown, and further having a sectional shape like an inverse hollow plate with an edge foot 10*a* to touch on the patch cloth(not shown), block ports 10*b* to receive the blocks 1' (plurality of 10*b* may be recognized by FIG. 3) and hook ports 10*d*, 10*d* to receive hook nails 2', 2''.

The numeral 4 represents portions, located in FIG. 1 above the elements noted hereinbefore, but not limited to configuration, to actuate hooking and unhooking actions in connection with placing and displacing actions of the device as a whole, where a pair of scissor arms 5,5 (shown in FIGS. 1 and 2, but abbreviated in FIG. 3) are arranged with their arm tips 5',5' touched to the outer top tips of the arms 2, 2 and these arms 5, 5 are pivoted at 5*a*, 5*a* and at the shank ends, a pair of rollers 6, 6 are mounted with a small gap inbetween. This gap is bridged by a spring 7 to keep a certain gap length. The numeral 8 is an air cylinder, positioned between a pair of scissor arms 5, 5, to move a tapered piston head 9 which will wedge into a pair of rollers, 6, 6. Then 12 is a stopper, extended from and secured around the fulcrum 5*a*, to control the wedging action noted above. And the actuator means represented by the numeral 5 is connected with the hook means having the basic numerals 1 and 2, therefore it is understood that the elements represented by 4 as well as the elements represented by 1 and 2 are adapted to displace or move together as one unit.

In operation, a pocket cloth is first set on a suit fabric where said pressure foot 10 having a similar shape to the pocket cloth is next laid on the pocket cloth manually. Then, the device comprising actuation means and hook means is operated to come down along the columns G, G as one unit consisting mainly of the base plate 1, the beam 1*a*, the scissor arms 5, the air cylinder 8 and the stopper 12. At the point of touch down between nails 2', 2' of the hook arms 2, 2 and the top edge 10*e* of the pressure foot 10, the downward move stops and the nails 2, 2 come into the hook ports 10*d* and catch the edges 10*e* as shown in FIG. 1 while the blocks 1' enter into the block ports 10*b* and the top face 10*c* of the pressure foot 10 is pressed down. Consequently, the pressure foot 10 is fixed in place and then the hem sewing will take place.

In the meantime of said sewing operation, it is recommended to prepare the next job on a side table, for instance, including setting of the other suit fabric whereon a pocket cloth and a pressure foot are laid.

Figure 2:
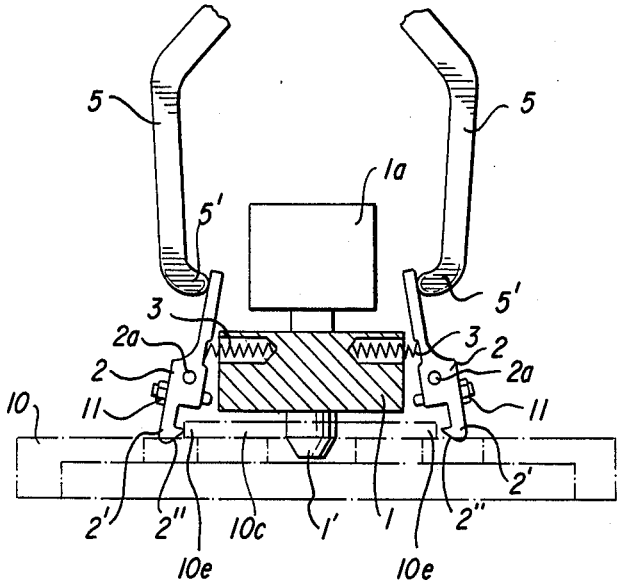
FIG. 2 is a partial, excerpted drawing to show how the device is releasing the pressure foot by unhooking action.
Figure 3:
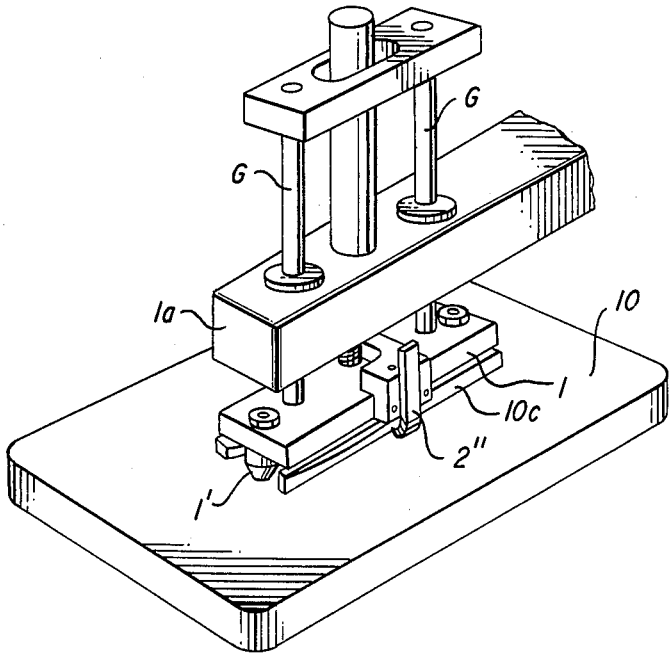
FIG. 3 shows a perspective view of the device with some simplicity, but with complement to abbreviations in FIG. 1.

When the outstanding hem-sewing finishes, the air cylinder 8 is operated to push the piston head 9 into a pair of rollers 6, 6, by which the scissor arms 5, 5 make a close at their arm tips 5', 5' as shown in FIG. 2 and thereby the nails 2', 2' are opened or unfixed as also shown in FIG. 2. Then the device present above the pressure foot 10 starts to displace upward.

As is seen from descriptions above, placement and displacement work for a pressure foot, are rationalized by this invention, whereby an idling time with operators will be saved. It is further understood by those skilled in the art that the foregoing description is directed to a preferred embodiment of the disclosed device and that various changes and modifications may be made in the invention without departing from the spirit and scope thereof.

I claim:

1. A device for placing a pressure foot for positioning a fabric to be sewn by a sewing machine, a placement means for holding the pressure foot on the sewing machine during a sewing operation, said placement means comprising a pair of hook means releasably engagable with the pressure foot to hold the same in place, and an actuating means for causing the hook means to release the pressure foot, said hook means and said actuating means being displaceable together as a unit toward and away from said pressure foot.

2. The invention of claim 1, said hook means comprising a pair of hook arms having hook ends which are resiliently urged inwardly to a pressure foot engaging position such that the hook ends would engage a pressure foot when the unit is located at the pressure foot.

3. The invention of claim 2, said actuating means comprising a pair of pivoted scissor arms, and including means for urging said scissor arms to cause them to act on the hook arms to release the pressure foot.

4. The invention of claim 3, said scissor arms both being pivotally mounted, the ends of said arms on one side of said pivots engaging said hook means, and said means for urging the scissor arms comprising a wedge positioned to act on portions of the scissor arms on the side of their respective pivots opposite from the side which engages the hook arms.

5. The invention of claim 4, said portions comprising rollers formed on ends of the scissor arms, resilient means for normally urging said rollers towards each other and wherein said wedge is positioned to move between the rollers to move said portions of the scissor arms apart and thereby, through the pivot connections, urge the opposite ends of the scissor arms towards each other to engage the hook arms to release the presser foot.

* * * * *